US007225485B2

(12) United States Patent
Binder

(10) Patent No.: US 7,225,485 B2
(45) Date of Patent: Jun. 5, 2007

(54) SUPPORT WITH BUOYANCY CUSHIONS

(75) Inventor: Patricia Binder, 1924 NE. Couch #101, Portland, OR (US) 97332

(73) Assignee: Patricia Binder, Portland, OR (US)

( * ) Notice: Subject to any disclaimer, the term of this patent is extended or adjusted under 35 U.S.C. 154(b) by 0 days.

(21) Appl. No.: 11/207,434

(22) Filed: Aug. 19, 2005

(65) Prior Publication Data

US 2006/0037142 A1 Feb. 23, 2006

Related U.S. Application Data

(60) Provisional application No. 60/603,345, filed on Aug. 20, 2004.

(51) Int. Cl.
*A47G 9/00* (2006.01)

(52) U.S. Cl. ..... 5/644; 5/645; 5/622; 5/638

(58) Field of Classification Search ..... 5/622, 5/636–640, 643–645, 654, 655.5, 657
See application file for complete search history.

(56) References Cited

U.S. PATENT DOCUMENTS

| | | | | |
|---|---|---|---|---|
| 2,688,142 | A | 9/1954 | Jensen | |
| 2,748,399 | A | 6/1956 | Rockoff | |
| 3,327,330 | A | 6/1967 | McCullough | |
| 3,611,455 | A | 10/1971 | Gottfried | |
| 3,702,484 | A | 11/1972 | Tobinick et al. | |
| 3,789,442 | A | 2/1974 | Tobinick | |
| 3,815,165 | A | 6/1974 | Tobinick et al. | |
| 3,828,377 | A | 8/1974 | Fary, Sr. | |
| 4,752,064 | A | 6/1988 | Voss | |
| 4,753,480 | A * | 6/1988 | Morell | 297/452.27 |
| 4,753,705 | A | 6/1988 | Poncy | |
| 4,829,614 | A * | 5/1989 | Harper | 5/644 |
| 4,847,931 | A | 7/1989 | Bard | |
| 4,930,171 | A | 6/1990 | Frantz | |
| 5,371,909 | A * | 12/1994 | McCarty | 5/655 |
| 5,613,501 | A | 3/1997 | Michelson | |
| 5,636,395 | A | 6/1997 | Serda | |
| 5,642,543 | A * | 7/1997 | Huntley | 5/640 |
| 5,778,469 | A | 7/1998 | Festa | |
| 5,918,335 | A | 7/1999 | Han | |
| 6,230,348 | B1 * | 5/2001 | Patrikakis | 5/636 |
| 6,367,105 | B1 | 4/2002 | Farley | |
| 6,374,441 | B1 | 4/2002 | Begell | |
| 6,421,859 | B1 | 7/2002 | Hicks et al. | |
| 6,449,788 | B1 * | 9/2002 | Nichols | 5/636 |
| 6,487,737 | B1 * | 12/2002 | Futagami | 5/644 |
| 6,658,681 | B2 * | 12/2003 | Britto et al. | 5/655 |
| 6,671,908 | B2 * | 1/2004 | Brown et al. | 5/644 |

* cited by examiner

*Primary Examiner*—Michael Trettel
(74) *Attorney, Agent, or Firm*—Alleman Hall McCoy Russell & Tuttle, LLP

(57) ABSTRACT

A support for supporting at least a part of the human body is provided. In some embodiments, the support may include a support body having a first resistance to deformation and at least one buoyancy cushion having a second resistance to deformation, wherein said buoyancy cushion is substantially disposed at least partially within said support body.

15 Claims, 5 Drawing Sheets

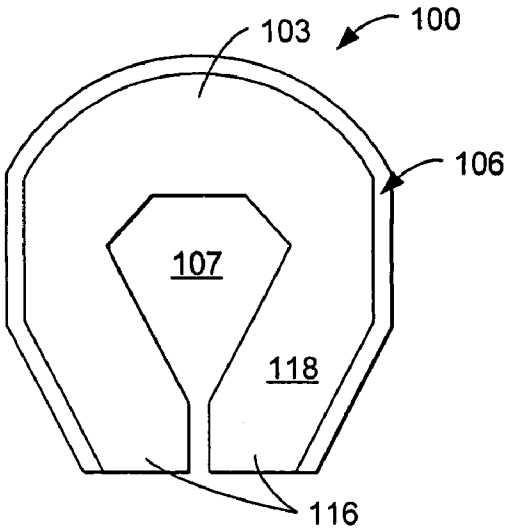
FIG. 2A
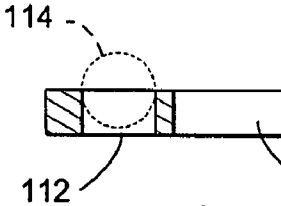
FIG. 2B
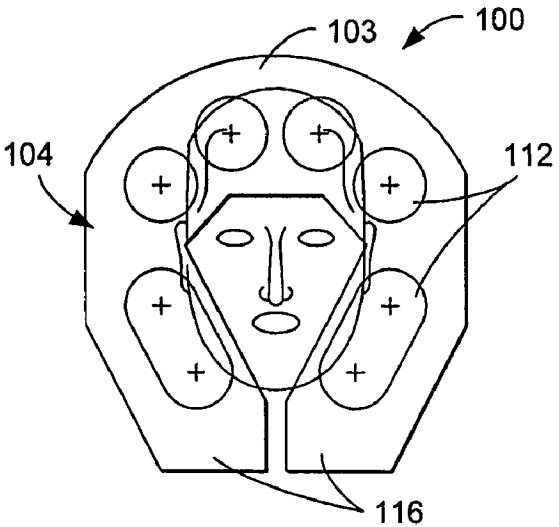
FIG. 3A
FIG. 3B
FIG. 4A
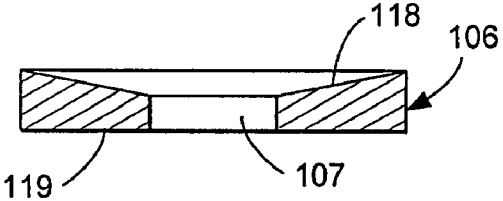
FIG. 4B

SUPPORT WITH BUOYANCY CUSHIONS

CROSS-REFERENCE TO RELATED APPLICATION

The present application claims priority to U.S. Provisional Patent Application Ser. No. 60/603,345 of Patricia Binder, entitled SUPPORT WITH BUOYANCY CUSHIONS filed Aug. 20, 2004, the disclosure of which is hereby incorporated by reference.

TECHNICAL FIELD

The present disclosure relates generally to support devices. In some embodiments, the support devices may be adapted to support body parts, such as the head, face, spine, etc.

BACKGROUND

Various types of devices have been developed to support parts of the human body. For example, such devices may be used to support one or more body parts when sitting, riding, kneeling, traveling, resting, lying face down, etc. Typically, where the body contacts a surface for an extended period of time, especially where pressures are applied to the body, through gravity or otherwise, some sort of padded support may be desired for comfort and/or support.

Examples of known head and/or face supports are disclosed in U.S. Pat. Nos. 5,613,501; 6,374,441; 4,752,064; 3,828,377; and 2,688,142, the disclosures of which are incorporated by reference in their entirety for all purposes.

To provide the desired comfort and/or support, cushions, pillows, and the like have been stuffed with foam padding or similar materials. However, many of these supports do not give or conform sufficiently to the isolated body parts targeted for support. For example, the desired relief from pressure may not be realized because the foam in the cushion may push back against the body part, rather than yielding to the pressure of the body part.

As an example, during therapeutic message, physical therapy, or chiropractic work, a patient may be requested to lie face downward on a table. Head supports may be integrated or provided on the table to support the patient's face. These head supports may only slightly conform to an individual patient's contour. Patients may complain that their face feels crushed or contorted against the head support. Further, the pressure on certain parts of a patient's head from the head support may cause discomfort or pinching. For example, some patients may find that their sinus areas are compressed by the head support, and in some instances, such patients may find that normal breathing is difficult.

To address the above concerns and as described herein, a support may be provided with buoyancy cushions. In some embodiments, the buoyancy cushions may be strategically positioned within the support to accommodate a specific portion of the body. Thus, in some embodiments, the disclosed support may accommodate the varying size and shapes of body parts while simultaneously providing cushioning and weight support.

SUMMARY

A support for supporting at least a part of the human body is provided. In some embodiments, the support may include a support body having a first resistance to deformation and at least one buoyancy cushion having a second resistance to deformation, wherein said buoyancy cushion is substantially disposed at least partially within said support body.

In some embodiments, a head support structure is provided. The head support structure may include a support body having a substantially U-shaped configuration including two support arms and a forehead support coupling the two support arms, and a plurality of buoyancy cushions disposed within said support body in a pattern corresponding to features of the head.

In some embodiments, a head support may be provided including a body having a first support surface and a plurality of fluid-filled buoyancy cushions. The buoyancy cushions may provide a pressure relief zone.

BRIEF DESCRIPTION OF THE DRAWINGS

The disclosure is illustrated by way of example and not by way of limitation in the figures of the accompanying drawings, in which the like references indicate similar elements and in which:

FIGS. 2A and 2B illustrate a plan and cross-sectional view of a first layer of a head support according to an embodiment of the present disclosure.

FIGS. 3A and 3B illustrate a plan and cross-sectional view of a second layer of the head support of FIG. 2.

FIGS. 4A and 4B illustrate a plan and cross-sectional view of a third layer of the head support of FIG. 2.

DETAILED DESCRIPTION OF DEPICTED EMBODIMENTS

Figure 1:
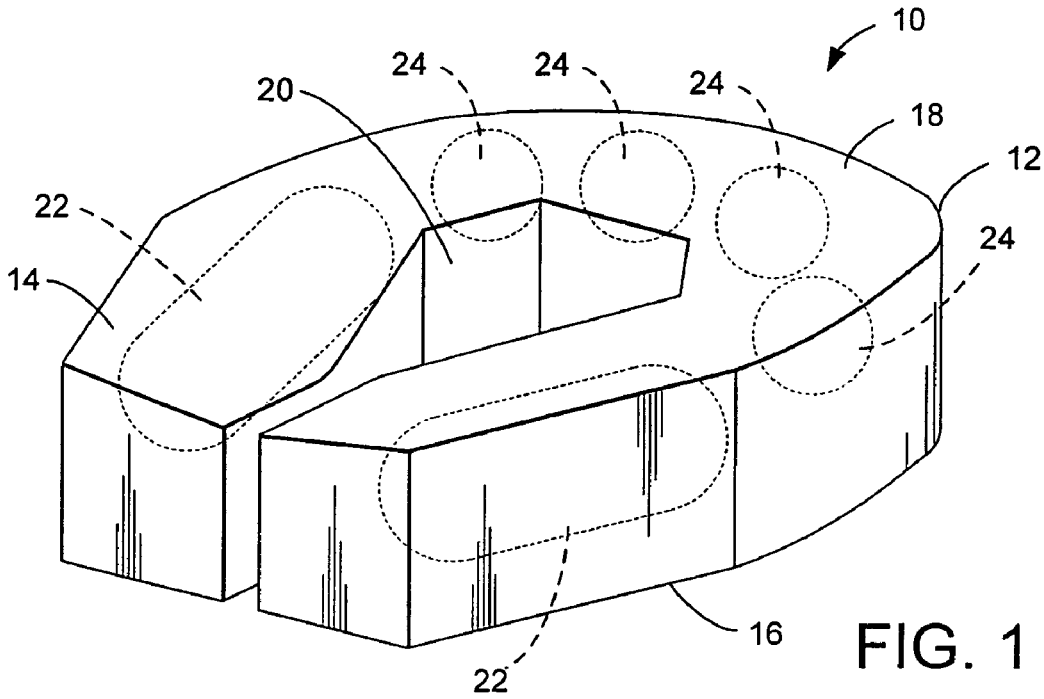
FIG. 1 shows a perspective view of an exemplary head support according to an embodiment of the present disclosure.

An exemplary support constructed according to the present disclosure is shown generally at 10 in FIG. 1. Although described in regards to use as a head and face support, it should be appreciated that the support may be configured for use with any body part, including, but not limited to configurations adapted as back supports, seats, leg and foot supports, body rests, body guards and protective armor, etc. Further such supports may be used to prevent injury of one or more body parts. For example, the support may be configured to provide comfort and protection during activities, such as sporting activities, extended sitting periods, etc.

Typically, support 10 includes a body 12. Depending on the use of support 10, body 12 may be shaped to accommodate a specific body part. For example, in the illustrated embodiment, support 10 is horseshoe-shaped or U-shaped to accommodate a user's face. Specifically, body 12 includes a first arm 14 and a second arm 16. First arm 14 and second arm 16 may be coupled together via forehead support region 18. First arm 14 and second arm 16 may be configured to support the cheek or sides of a user's face when a user is lying face downwards on a substantially planar surface. An opening 20 may be provided within the body 12 to enable the eyes, nose and mouth of a patient to be clear from the support.

Body 12 may be of any suitable material which provides compressible support. For example, body 12 may be substantially composed of foam. In some embodiments, the foam may be segmented, layered, or alternatively, in some embodiments, the foam may be a continuous piece.

The foam within body 12 may be of any suitable type. In some embodiments, different types of foam or other materials, such as foam with different levels of compression, may be disposed to form body 12. For example, in layered embodiments, soft foam may be interposed between two hard foam layers, or alternatively, soft foam may be used as a top layer with harder foam bottom layers. Additionally, regions of the body may have different foam compression levels. Thus, in some embodiments, foam of different compression levels may be disposed in a layered configuration or region-dependent configuration. It should be appreciated that other configurations are possible and are within the scope of the disclosure.

Typically, resilient closed cell foam, or the like, may be used within body 12 to prevent contamination of the body of the support. Although, in some embodiments, open cell foams may also be used. Further, in some embodiments, a protective coating or slip (not shown) may be fitted over the foam to create a ready-to-use sanitary support. In some embodiments, the coating may be removable for cleaning or disposal.

Further included within body 12 may be one or more buoyancy cushions 22, 24. Although shown as having multiple cushions, it should be appreciated that in some embodiments, a single cushion may be incorporated in body 12. Moreover, although shown as having six cushions, any number of cushions may be utilized without departing from the scope of the disclosure.

In some embodiments, buoyancy cushions 22, 24 may be placed within the foam to enable greater deformation of the support where the deformation is targeted for specific regions of the face, such as the sinus areas, when a user is face down on support 10. Different embodiments may include buoyancy cushions in different locations within the support, thus enabling more or less deformation for various parts of the body, such as the forehead, jaw, cheek and/or chin regions. In this manner, the foam body having a greater resistance to deformation may therefore be utilized to support a greater proportion of the force supplied by the body part, while the buoyancy cushion may provide a more deformable support.

For example, a head support may include a body having a first support surface. The first support surface may be a region where the head is supported by the body of the support, e.g. the foam body supports the head of a user. The head support may further include a plurality of fluid-filled buoyancy cushions included with the body, where the buoyancy cushions provide a pressure relief zone. The pressure relief zone may be an area where less force is applied back against the face when it is pressed into the support. For example, the pressure relief zone may be a region of higher deformation, or compression. It should be appreciated that the buoyancy cushions may form a second support surface, where the second support surface provides a different responsive force back to the head than the first support surface.

Alternatively, in some examples, the buoyancy cushions 22, 24 may be constructed to deform less than foam body 12. In this manner, buoyancy cushions of greater resistance to deformation may be utilized to transfer the force to parts of the body better able to accept the increased applied pressure. In yet another embodiment, support 10 may include a plurality of buoyancy cushions of varying fluids and/or deformation in order to achieve a desired support structure.

Thus, as an example, a support for supporting a body part may be provided. The support may include a support body having a first resistance to deformation and at least one buoyancy cushion having a second resistance to deformation. In some embodiments, the first resistance to deformation of the support body may be greater than the second resistance to deformation of the at least one buoyancy cushion. In other embodiments, the first resistance to deformation of the support body may be less than the second resistance to deformation of the at least one buoyancy cushion. Moreover, in some embodiments, different buoyancy cushions within the support body may have different resistances to deformation, thus providing different levels of body support.

In the depicted embodiment, two types of cushions 22, 24 are illustrated. Specifically, cheek support cushions 22 are shown in first arm 14 and second arm 16. Cheek support cushions are shown as extended casings which may be disposed such that the long axis of the cheek support cushions runs parallel to the long axis of the first and second arm. In addition, a plurality of isolated cushions 24 may be disposed in the forehead support region 18. These isolated cushions may be of any suitable size and shape. For example, they may be spherical or substantially spherical prior to applied pressure. Upon pressure, the cushions may deform in response to the applied force. Use of the multiple isolated cushions may be useful to accommodate a specific critical pressure point of the body.

It should be appreciated that although only two different types of support cushions are shown, other sizes and shapes of cushions may be used without departing from the scope of the disclosure. For example, the isolated cushions and/or cheek cushions may be of different sizes depending on the area of intended contact. Moreover, the shape of the isolated cushions and/or cheek supports may vary depending on the intended use of the support.

Typically, buoyancy cushions 22, 24 are fluid-filled packs. Any suitable fluid may be contained within the buoyancy cushions. For example, in some embodiments, buoyancy cushions 22, 24 may be filled with saline, silicon, water, gel or other suitable substance. The buoyancy cushions may be configured to accommodate a body part, increasing the comfort of the support against the body part. The buoyancy cushions may thus be strategically placed within the support to increase a user's comfort when using the support. Thus, the buoyancy cushions may be configured to isolate critical points of the body, deforming differently than the foam body thus providing relief to specific body parts. In such a configuration, the buoyancy cushions may be considered relief cushions, such as sinus relief cushions.

Additionally, or alternatively, foam cushions or pockets of different deformation characteristics may also be included within the support body. These foam cushions may be provided as support cushions and/or relief cushions.

For example, in use, support 10 may be positioned on a therapist's table such that a patient may lie face down with his or her face engaging support 10. The buoyancy cushions may be disposed at or substantially close to key locations of contact between the face and the support. The buoyancy cushions deform from the pressure caused by the face, thus accommodating the shape of the face and minimizing discomfort or soreness of the in-contact regions of the head and face.

FIGS. 2–4 illustrate another support 100 according to an embodiment of the present disclosure. Specifically, FIGS. 2–4 illustrate a layered support, with FIG. 2 showing a first or bottom layer 102, FIG. 3 showing a second or middle layer 104, and FIG. 4 showing a third or top layer 106. Each layer generally forms a forehead support region 103 and side arm regions 116. Although shown having three layers, it should be appreciated that the support may have more or less layers than the illustrated support, without departing from the scope of the disclosure. Thus, while this embodiment uses three layers for ease and cost of manufacturing, head support 100 may be formed through different numbers of layers, including 1, 2, 4, or 5 layers, and so forth. Dimensions are provided on the figures, however such dimensions are for illustrative purposes only and may vary according to the type of support, the size of the support, the needs of the therapist, the type of use, etc.

As illustrated, support 100 may be a modified crescent shape with an opening or aperture 107. First layer 102 may have a bottom surface 108 (indicated in the sectional view of first layer 102 in FIG. 2). Bottom surface 108 may be configured to engage against a surface, such as a substantially planar surface, e.g. a bed or table. In some embodiments, bottom surface 108 may include friction retention features or similar structures to retain support 100 in a select position. For example, bottom surface 108 of first layer 102 also may include hook and loop fastening strips, such as a VELCRO™ strip 110 (shown in FIG. 6), or similar device, to allow selective attachment of head support 100 to and from headrest platform 120 (shown in FIG. 6).

First layer 102 of support 100 may be made of foam, rubber or other suitable solid support material. Typically, such material enables some compression, while still providing support for the body. As described above, in some embodiments, first layer 102 may be made of resilient closed cell foam or the like to prevent contamination of the support.

Figure 5:
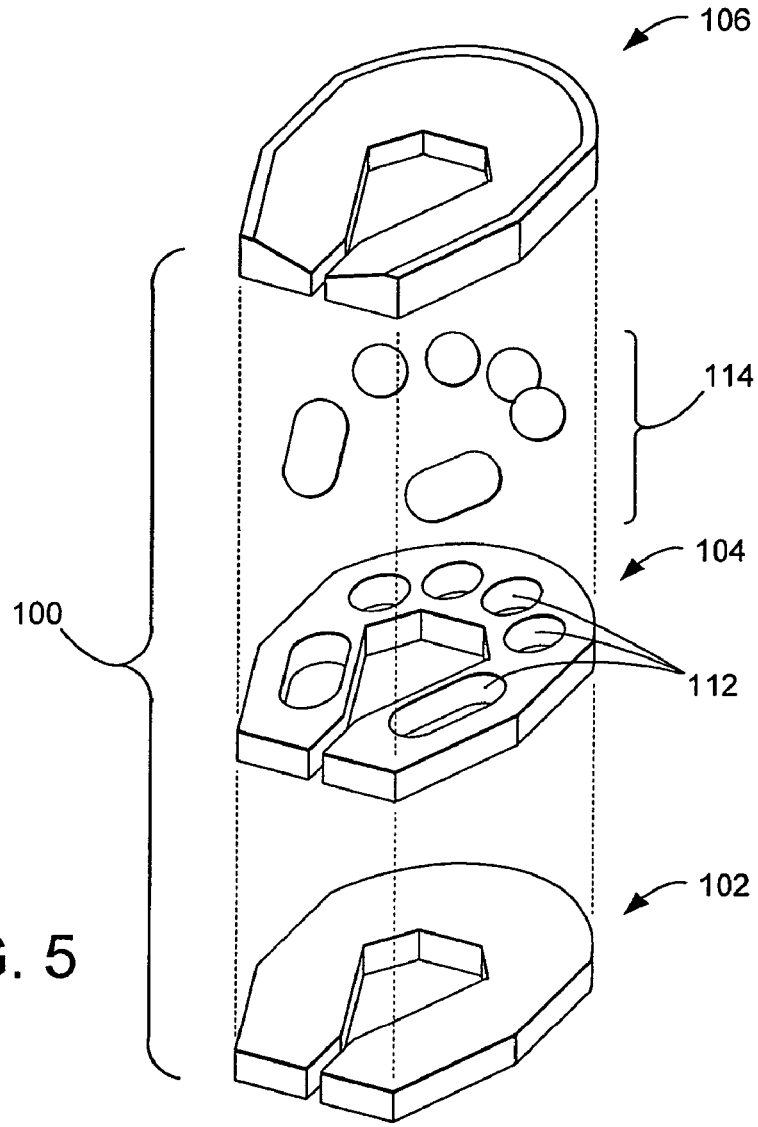
FIG. 5 provides an exploded view of the head support of FIGS. 2, 3 and 4.
Figure 6:
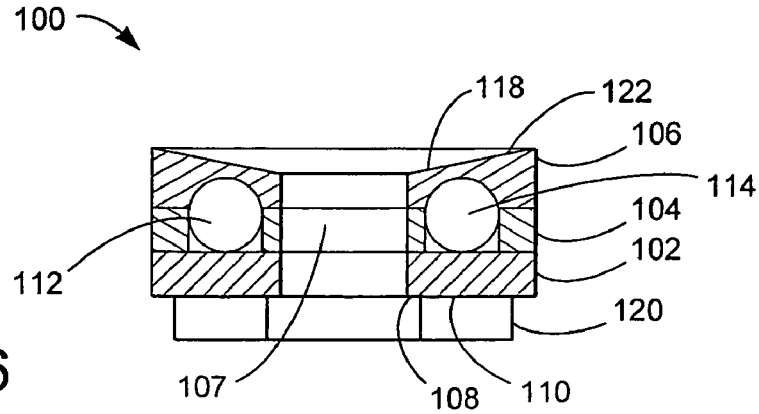
FIG. 6 provides a cross-sectional view of the head support of FIGS. 2, 3 and 4.

In the example embodiment, a second foam layer 104, as shown in FIG. 3, may include receiving slots 112 for one or more buoyancy cushions 114 (shown in FIGS. 5–6). Receiving slots 112 may correspond and accommodate buoyancy cushions 114. In some embodiments, receiving slots 112 may substantially envelope the buoyancy cushions, thus retaining the buoyancy cushions in a preselected configuration.

As described above, the buoyancy cushions may be fluid-filled sacks, filled with any suitable fluid or gel, including for example, silicon or saline. Buoyancy cushions 114 may be of variable shape and size and may be placed in a variety of locations and still be within the scope of this disclosure. Thus, receiving slots may be formed with a variety of patterns to accommodate these different embodiments. For example and described in more detail below, FIG. 7 shows multiple supports with different combinations of shapes, sizes, and numbers of buoyancy cushions 114 placed in a variety of locations within the support. Slots may be provided in any one of the layers or combination of layers to retain such buoyancy cushions. Such embodiments are provided for illustrative purposes and are not intending to be limiting to the disclosure.

Further referring to FIGS. 3 and 5, as discussed above in one embodiment, cheek support and/or isolated buoyancy cushions may be provided in support 100. In addition, a plurality of isolated buoyancy cushions may be disposed in the forehead support region 103. These cushions may be of any suitable size and shape. For example, they may be substantially spherical, substantially ellipsoidal, or any other shape prior to deformation from an applied pressure. Use of the multiple isolated supports may be useful to accommodate a specific critical pressure point of the body.

Similar to first layer 102, middle layer 104 may be made of foam or other suitable compressible material. As with first layer 102, middle layer 104 may be composed of closed cell foam or the like to prevent contamination of the support. In some embodiments, buoyancy cushions 114 may sit above the top level of middle layer 104 such that the buoyancy cushions protrude into third layer 106, as shown in FIG. 6.

Top layer 106, shown in FIG. 4, has an upper surface 118 and lower surface 119. Lower surface 119, in the depicted embodiment, may be adapted for receipt of the top of buoyancy cushions 114 such that the buoyancy cushions extend into top layer 106. The buoyancy cushions may be disposed a select distance from the upper surface to provide a select amount of support and cushion to a user. Depending on the location of the cushion and the support and/or relief to be provided by the cushion, the cushion may be disposed shallower or deeper within the support. Thus, the buoyancy cushions may be disposed to increase or decrease a user's interaction and contact with the cushions when using the support.

For example, top layer 106 may be made of viscoelastic memory foam, or other suitable compressible foam. The top layer may be configured such that it easily compresses to enable a user to interact directly (or indirectly depending on the configuration of the support) with buoyancy cushions 114.

It should be noted that in the illustrated embodiment, upper surface 118 of top layer 106 may be formed so that upper surface 118 slants at a downward angle toward aperture 107. This configuration for upper surface 118 may provide a contoured surface for the face and head, and may also operate to orient buoyancy cushions 114 substantially proximate the isolated regions of the face where alleviating pressure is desired, such as in the sinus regions of the face. Although shown with the upper surface angled, it should be appreciated that the upper surface may be of any select configuration.

Layers used in forming head support 100 may be arranged as shown in FIG. 5 according to one embodiment. As such, middle layer 104 may be disposed on top of bottom layer 102. Buoyancy cushions 114 may be placed substantially within pre-formed slots 112 in middle layer 104, although buoyancy cushions 114 may project higher and/or lower than middle layer 104. Finally, top layer 106 may be disposed on top of middle layer 104 and buoyancy cushions 114. As described above, top layer 106 may be configured to receive the top portions of buoyancy cushions 114. Although shown with a top layer, in some embodiments, no top layer of foam may be used. In such embodiments, a user may directly engage (or engage a cover layer covering) the buoyancy cushions. Differing numbers of layers may accord a different order as that shown without departing from the scope of this disclosure.

When combining layers 102, 104 and 106 of head support 100, any method of adhering foam materials may be employed. However, in some embodiments, care may be taken to leave the surface portions of first layer 102 and third layer 106 such that contact with buoyancy cushions 114 is substantially free of adhesive, enabling at least partial movement of buoyancy cushions 114 within receiving slots 112.

FIG. 6 shows the combination of layers 102, 103, and 104, as discussed in FIG. 5, but in a cross-sectional view, and located on top of a headrest platform 120. Bottom surface 108 of first layer 102 also may include a VELCRO™ strip 110, or similar device, to allow selective attachment of head support 100 to and from headrest platform 120 of a table. Once again, indications of dimensions are illustrative only, and may be changed according to differing sizes of tables, and needs of the therapist or doctor. Also shown is a cover 122 that may be employed on top of head support 100 for additional comfort, cleanliness and a longer-life of head support 100.

As discussed above in regards to FIG. 3, receiving slots 112 show an exemplary configuration for location of buoyancy cushions 116 within support 100. However, any other suitable arrangement is possible. For exemplary purposes, FIG. 7 provides alternative configurations for the positioning of buoyancy cushions 114 within a support. It will be appreciated that these further configurations are illustrative only, and not meant to be exhaustive of the various possible combinations of shapes, sizes, and locations of buoyancy cushions 116.

Figure 7A:
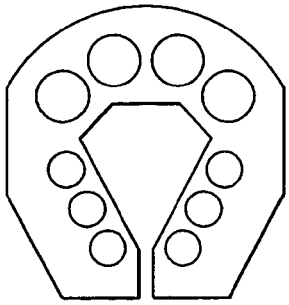
FIG. 7 shows examples of other possible alternative embodiments of different location combinations for the buoyancy cushions within a head support according to various other embodiments of the present disclosure.

For example, FIG. 7A shows generally spherical cushions in the forehead region, along with a plurality of somewhat smaller, generally spherical cushions in the jaw and cheek/chin region.

Figure 7B:
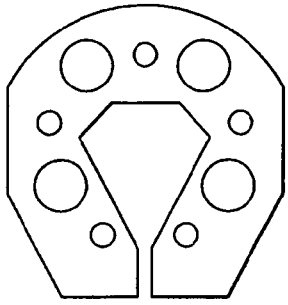

FIG. 7B shows an alternating pattern of larger and smaller generally spherical cushions concentrated both in the forehead region, as well as in the jaw and cheek/chin region.

Figure 7C:
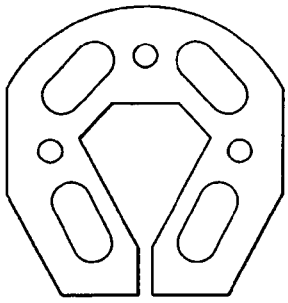

FIG. 7C shows alternating elongated oblong cushions with smaller, generally spherical cushions concentrating the oblong cushions on both temples of the forehead, and on both jaws of the chin. Oblong cushions may run longitudinally parallel with the long axis of the arms of a support.

Figure 7D:
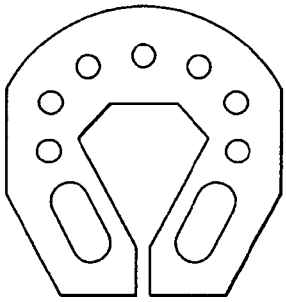

FIG. 7D shows two elongated oblong cushions centered on an even larger area of the jaw/chin region than in FIG. 7C, while spreading intermediate-sized, generally spherical cushions throughout the temple and forehead regions. Oblong cushions may run longitudinally parallel to the long axis of the arms of a head support.

Figure 7E:
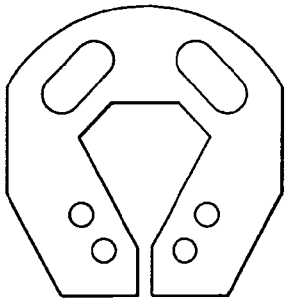

FIG. 7E concentrates two elongated oblong cushions centered about the temple regions, and a pair of two intermediate-sized cushions in the jaw/chin region. Oblong cushions may run longitudinally parallel to the opening, spanning substantially the upper corners of a head support.

Figure 7F:
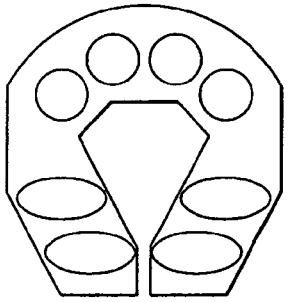

FIG. 7F shows a plurality of intermediate-sized cushions in the forehead region along with a pair of two elongated oblong cushions in the jaw/chin area. The oblong cushions may run perpendicular to the long axis of the arms of a head support.

Figure 7G:
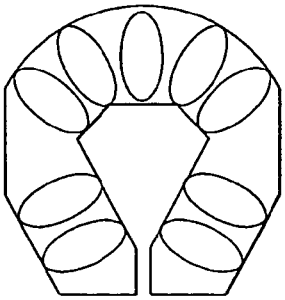

FIG. 7G shows a plurality of elongated oblong cushions in two groups: a plurality in the forehead and temple regions, and a set of multiple cushions in the jaw/chin area. All of these oblong cushions may run generally perpendicular to the opening of a head support.

Figure 8:
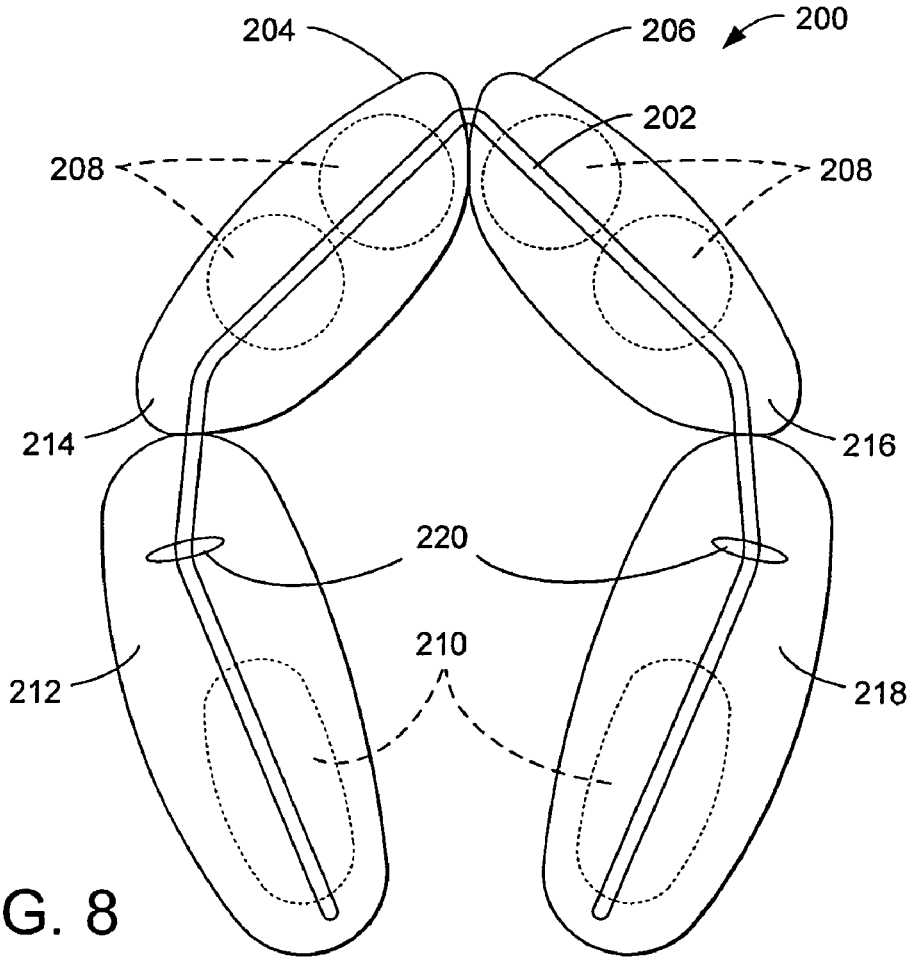
FIG. 8 shows a plan view of an alternative embodiment of a head support according to an embodiment of the present disclosure.

FIG. 8 shows another embodiment of a head support 200. Head support 200 may include a frame 202 contained within body 204. Frame 202 may be a pliable or shapeable rod or wire. In some embodiments, frame 202 may be composed of plastic, metal, or any other suitable material. As shown, frame 202 may be generally shaped as a head cradle; however, other configurations are possible and are within the scope of the disclosure.

Frame 202 may be surrounded by foam 206 such that frame 202 is embedded within foam 206. Also embedded within foam 206 may be one or more buoyancy cushions, such as buoyancy cushions 208, 210. In some embodiments, a single layer of foam may include slots for receipt of the buoyancy cushions. In other embodiments, one or more of the segments (discussed below) may be multi-layered.

As shown, body 204 may be segmented, as indicated by first segment 212, second segment 214, third segment 216 and fourth segment 218. Frame 202 may extend between each of the segments such that the segments may be selectively adjusted relative to each other. These segments may be selectively positioned for compatibility to individual head shapes and desired support.

In some embodiments, support 200 may include a hinge 220 or another jointed device that enables a user to selectively position one or more of the segments or portions of the segments in a desired location. Hinge 220 is provided as an exemplary hinge, and additional hinges in different locations may be provided and are within the scope of the disclosure. By providing such adjustment capabilities, a user may be able to adjust the support to accommodate the size of a user's face.

The combination of adjustability and the buoyancy cushions may enable a user to more comfortably position a head support during massage. It should be understood that a combination of features of different embodiments disclosed herein may be employed favorably as well.

In some embodiments, it should be appreciated that a method of arranging a support structure for supporting at least a part of the human body is provided. In an exemplary method, the support structure may include a support body with a first resistance to deformation and at least one buoyancy cushion with a second resistance to deformation. In some embodiments, the location of said buoyancy cushion may be adjusted relative to said support body based on a first condition. Moreover, the quantity of said buoyancy cushions may be adjusted based on a second condition. The first condition may be based on the body part to be supported. For example, the first condition may be the ratio of the first resistance to deformation and the second resistance to deformation. The second condition may be based on the mass of said body part to be supported. Such a method may be used in developing and/or manufacturing the supports. Additionally, some supports, may be selectively adjusted by a user.

Although described in regards to supporting the head and face, the support with buoyancy cushion(s) may be embedded in other body support structures, for example in head rests for traveling, in seat cushions, such as for sitting on stadium bleachers, or on a bicycle. Also, the disclosed support may be formed to support a person lying face up, for instance on a mechanic's crawler or for support of a head in an upright position, such as sitting on an airplane. These are just a few examples of other applications of the broad concepts disclosed herein, and other various examples which are described below.

For instance, in FIGS. 9–11B, there are several drawings that exemplify such possible alternate application(s) of the broad concepts of this disclosure. It should be appreciated that such examples are provided for illustrative purposes only and the disclosed support with buoyancy cushions may be used to support the body in other configurations not shown explicitly herein.

Figure 9:
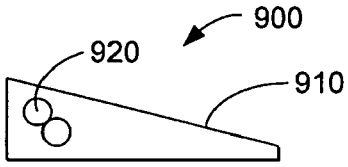
FIGS. 9 and 9A are views of another exemplary body support in the form of a seat according to an embodiment of the present disclosure.
Figure 9A:
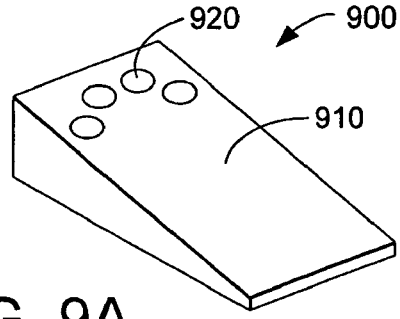

Discussing these exemplary drawings, FIGS. 9 and 9A show a wedge stadium cushion 900 that may be made of foam or other materials and contain one or more buoyancy cushions 920 strategically placed below the buttocks region. The base or body 910 may be made of high-density foam and may be preformed with impressions to accommodate the buoyancy cushions 920. The top layer may be formed of viscoelastic foam to better accommodate the contour of an individual user, whose buttocks may then favorably contact the underlying buoyancy cushion(s). A stretch vinyl cover may be employed on top of the uppermost layer for additional comfort, cleanliness, and longevity of the wedge cushion. It will be appreciated that this application may be incorporated into any variety of seats, including as a back support, a head support, lumbar support, etc.

In other examples, buoyancy cushions, such as those described above, and those illustrated schematically in FIGS. 9 and 9A, may be integrated into a bicycle seat. For example, a bicycle seat may include an exterior surface and a foam core with at least one buoyancy cushion located strategically therein. The cushion or cushions may be located to favorably support and prevent soreness in the buttocks region, especially where a person's body weight is most concentrated when riding. The location and type of buoyancy cushion may vary according to the type of riding the seat is designed for, i.e. road cycling, mountain biking, commuting, etc.

Another example of a use of the disclosed support is as a posture seat. Similar to the schematic configuration illustrated in FIGS. 9 and 9A, buoyancy cushions may be disposed in a seat to encourage improved posture and to lessen pressure on the spinal cord. For example, in one embodiment, a seat may include a foam core having strategically placed buoyancy cushion(s) located to pad the buttocks and outer thigh regions. Such an arrangement may provide support and comfort for extended sitters, or to those with spinal injuries and the like. For example, a seat support may aid the comfort of a user with an injury to the coccyx. The seat support may be integrated into a chair seat or may be removably placed on a chair for use by a user.

Figure 10:
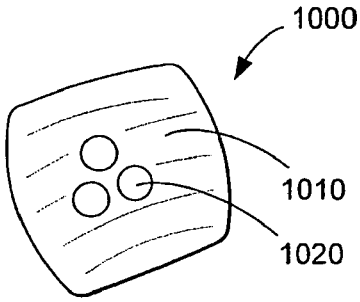
FIGS. 10, 10A and 10B are views of another exemplary body support in the form of a protective knee guard according to an embodiment of the present disclosure.
Figure 10A:
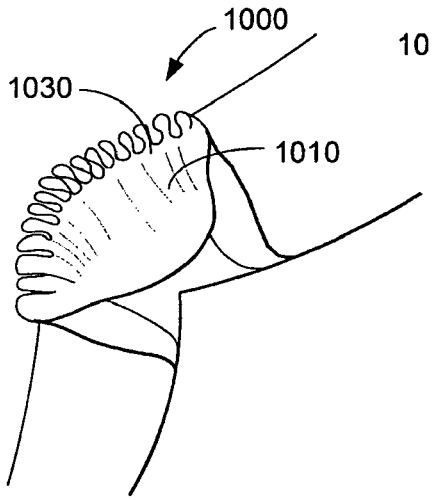
Figure 10B:
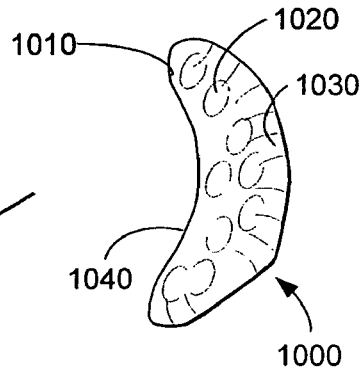

FIGS. 10, 10A and 10B show a support that may be integrated within body guard or body armor. As an illustration, a support is shown in the form of a knee pad. For example, a knee pad 1000 may include a body 1010, including an outer shell 1030 (indicated in FIG. 10A) which may be configured for surface contact. Internal to the outer shell may be a foam core with one or more buoyancy cushion(s) 1020. A flexible netting 1040 may be further disposed on the interior of the knee pad. The outer shell may alternatively be made of an accordion rubber material for better gripping, employment of which may depend on the application and/or intended use of the knee pad. This arrangement may provide improved support and shock absorbent characteristics to the knee upon surface contact.

Figure 11A:
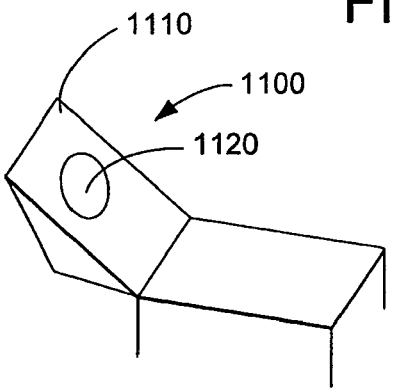
FIGS. 11A and 11B are views of another exemplary body support in the form of a head support integrated into a recliner according to an embodiment of the present disclosure.
Figure 11B:
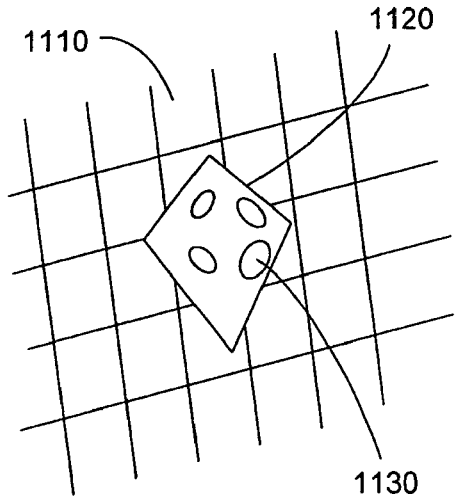

In yet another embodiment as shown in FIGS. 11A and 11B, a support may be integrated into furniture, such as a recliner or lawn chair 1100. A support 1120 may be integrated within the furniture as a seat, a back rest, and/or as a face support. For example, in some embodiments, a support may be integrated into a portion 1110 of a lawn chair such that a user may lie face down on the lawn chair where the support includes a plurality of buoyancy cushions 1130. With the user's head contacting the support, the user may find that lying face down is more comfortable.

Each of the above examples describes a body support with buoyancy cushions. It will be appreciated that the above applications are a representative list of other types of uses of the support, and such a list is in no way exhaustive; other applications and embodiments may fall within the scope of this disclosure.

Although the present disclosure includes specific embodiments, specific embodiments are not to be considered in a limiting sense, because numerous variations are possible. The foregoing embodiments are illustrative, and no single feature, component, or action is essential to all possible combinations that may be claimed in this or later applications. The subject matter of the present disclosure includes all novel and nonobvious combinations and subcombinations of the various elements, features, functions, and/or properties disclosed herein.

The following claims particularly point out certain combinations and subcombinations regarded as novel and nonobvious. These claims may refer to "a" or "a first" element or the equivalent thereof. Such claims should be understood to include incorporation of one or more such elements, neither requiring nor excluding two or more such elements. Further, ordinal numbers, such as first, second, and third, for identified elements or actions are used to distinguish between the elements and actions, and do not indicate a required or limited number of such elements or actions, nor a particular position or order of such elements or actions unless otherwise specifically stated. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A support for supporting at least a part of the human body, comprising:

a support body having a first resistance to deformation wherein said support body is substantially U-shaped;

at least one buoyancy cushion having a second resistance to deformation;

wherein said buoyancy cushion substantially disposed at least partially within said support body.

2. The support of claim 1, wherein said buoyancy cushion is a fluid-filled sack.

3. The support of claim 1, wherein said buoyancy cushion is substantially spherical shaped.

4. The support of claim 1, wherein said buoyancy cushion is substantially ellipsoid shaped.

5. The support of claim 1, wherein said first resistance to deformation is greater than said second resistance to deformation.

6. The support of claim 1, wherein said second resistance to deformation is greater than said first resistance to deformation.

7. The support of claim 1, wherein said support body has at least one slot for accepting the at least one buoyancy cushion.

8. The support of claim 1, wherein said support body is made of foam.

9. The support of claim 1, wherein at least a portion of the support body is made of viscoelastic memory foam.

10. The support of claim 1, wherein the support body includes a plurality of foam layers.

11. A bead support structure, comprising:

a support body having a substantially U-shaped configuration including two support arms and a forehead support coupling the two support arms; and a plurality of buoyancy cushions disposed within said support body in a pattern corresponding to features of the head.

12. The head support structure of claim 11, wherein said buoyancy cushions include at least one of a substantially ellipsoid buoyancy cushion or a substantially spherical buoyancy cushion.

13. The head support structure of claim 11, wherein the support body includes at least two different foam layers.

14. The head support structure of claim 11, wherein at least one of the plurality of buoyancy cushions are relief cushions.

15. The head support structure of claim 11, wherein said support arms are connected to said forehead support by a hinged connection that allows for the rotation of said support arms relative to said forehead support.

* * * * *